US008579173B2

(12) United States Patent
Gustafsson et al.

(10) Patent No.: US 8,579,173 B2
(45) Date of Patent: Nov. 12, 2013

(54) STAPLER

(75) Inventors: Trygve Gustafsson, Åsenhöga (SE); Martin Elonsson, Huskvarna (SE); Torbjörn Lönkvist, Skeppshult (SE)

(73) Assignee: Isaberg Rapid AB, Hestra (SE)

( * ) Notice: Subject to any disclaimer, the term of this patent is extended or adjusted under 35 U.S.C. 154(b) by 431 days.

(21) Appl. No.: 12/519,760

(22) PCT Filed: Dec. 11, 2007

(86) PCT No.: PCT/SE2007/001097

§ 371 (c)(1),
(2), (4) Date: Jan. 31, 2010

(87) PCT Pub. No.: WO2008/076036

PCT Pub. Date: Jun. 26, 2008

(65) Prior Publication Data

US 2010/0133315 A1 Jun. 3, 2010

(30) Foreign Application Priority Data

Dec. 21, 2006 (SE) ..... 0602779

(51) Int. Cl.
*B27F 7/07* (2006.01)

(52) U.S. Cl.
USPC ..... 227/8; 227/109; 227/156

(58) Field of Classification Search
USPC ..... 227/8, 109, 113, 76, 124, 134, 152, 227/155, 156
See application file for complete search history.

(56) References Cited

U.S. PATENT DOCUMENTS

| | | | | |
|---|---|---|---|---|
| 1,773,823 | A | 2/1929 | Polzer | |
| 2,059,020 | A * | 10/1936 | Pankonin | 227/126 |
| 2,267,185 | A * | 12/1941 | Bauwens | 227/77 |
| 5,004,142 | A | 4/1991 | Olesen | |
| 2007/0210135 | A1 * | 9/2007 | Ivarsson | 227/134 |

FOREIGN PATENT DOCUMENTS

| | | |
|---|---|---|
| DE | 610274 | 3/1935 |
| DE | 646864 | 6/1937 |
| EP | 0724936 | 8/1996 |

(Continued)

*Primary Examiner* — Alexandra Elve
*Assistant Examiner* — Nathaniel Chukwurah
(74) *Attorney, Agent, or Firm* — Miles & Stockbridge, P.C.

(57) ABSTRACT

A stapler (1) by which a workpiece (11), preferably a sheaf of papers, is stapled together with a staple, which stapler (5) comprises a stapling head (2) accommodating staples and a driver (6) and connected pivotably by a pivot pin (4) to a bottom part (3) which comprises a lower element (9) and an upper element (8) which are connected to one another in such a way that they can be moved towards and away from one another (P) and which in an initial state are held in a locking position at a distance from one another by a locking device (17), with forming means (14, 15) arranged between the upper and lower elements, which forming means, when the staple has been fully driven into the workpiece at its insertion area (26) by the driver, are activated to bend the staple legs towards the workpiece as a result of the upper and lower elements moving towards one another when the locking device is released by an activating means (22) which is part of the locking device (17) being acted upon by an unlocking means (7) disposed on the stapling head, the activating means (22) of the locking device (17) being situated at a greater distance in the longitudinal direction (L) of the stapler from the pivot pin (4) than the insertion area (26) of the staple.

5 Claims, 8 Drawing Sheets

(56) References Cited

FOREIGN PATENT DOCUMENTS

| | | |
|---|---|---|
| GB | 462957 | 9/1936 |
| WO | WO 96/09917 | 4/1996 |
| WO | WO 03/057417 | 7/2003 |
| WO | WO 2005/075151 | 8/2005 |

* cited by examiner 1
2
3
4
5
6
7
8
9
10
11
13
15
16
17
P

STAPLER

TECHNICAL FIELD

The present invention relates to a stapler by which a workpiece, preferably a sheaf of papers, is stapled together with a staple, which stapler comprises a stapling head accommodating staples and a driver and connected pivotably by a pivot pin to a bottom part which comprises a lower element and an upper element which are connected to one another in such a way that they can be moved towards and away from one another and which in an initial state are held in a locking position at a distance from one another by a locking device, with forming means which are arranged between the upper and lower elements and which, when the staple has been fully driven into the workpiece at its insertion area by the driver, are activated to bend the staple legs towards the workpiece as a result of the upper and lower elements moving towards one another when the locking device has been released by an activating means which is part of the locking device being acted upon by an unlocking means disposed on the stapling head.

STATE OF THE ART

Staplers of the kind indicated are previously known. Staplers of substantially the same configuration as indicated above are referred to in WO 9609917, DE 646864, U.S. Pat. No. 1,773,823 and DE 610274. However, previous staplers have the disadvantages of requiring the application of too much force for releasing the locking device, which can lead to the stapler becoming prematurely worn, or of the locking device not being triggered because of being situated in a region where, in unfavourable conditions, the unlocking means of the stapling head does not achieve effective contact with the activating means of the locking device, with the result that the staple legs do not become bent.

Problem

There is thus a need for a stapler of the kind indicated above but with a locking device which does not require the application of great force for its release or is not released at all.

Solution

The invention here proposed provides a solution which overcomes the aforesaid disadvantages of a stapler of the kind indicated in the introduction and which is characterised in that in the longitudinal direction of the stapler the activating means of the locking device is situated at a greater distance from the pivot pin than the insertion area of the staple.

The present invention is further characterised in that the activating means is situated substantially along the longitudinal centreline of the stapler.

The present invention is yet further characterised in that the locking means is connected pivotably to the upper element and that via an edge region it is in locking contact with the lower element as a result, when the activating means is activated, of the edge region entering an aperture provided in the lower element, whereby the upper element can move towards the lower element.

The present invention is further characterised in that the edge region in the locking state is situated 0.3-1 mm to the side of the edge of the aperture.

Finally, the present invention is characterised in that the edge region is situated 0.3-0.5 mm to the side of the edge of the aperture.

BRIEF DESCRIPTION OF THE DRAWINGS

The invention is described in more detail below with reference to the attached drawings, in which.

PREFERRED EMBODIMENT EXAMPLE

Figure 1:
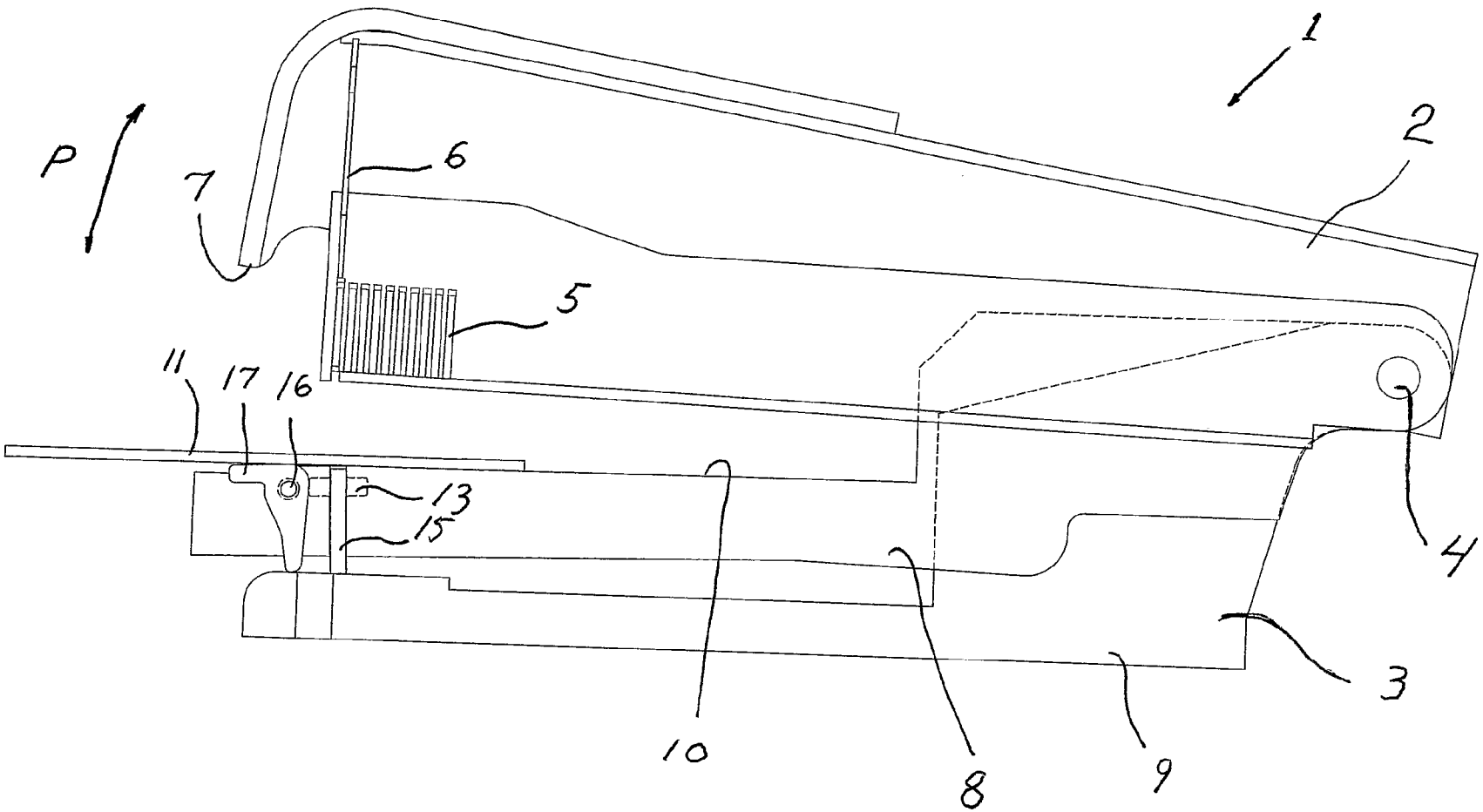
FIG. 1 is a schematic sideview of a stapler according to the present invention in an initial state.

FIG. 1 depicts schematically a stapler 1 which comprises a stapling head 2 and a bottom part 3 which are connected pivotably by a pivot pin 4.

The stapling head accommodates staples 5 stored in a magazine (not depicted in the drawing), and a driver 6. Also disposed on the stapling head is an unlocking means 7 whose function will be described below. The bottom part 3 comprises an upper element 8 and a lower element 9 connected to one another by the pivot pin 4. A workpiece 11, preferably a sheaf of papers, intended for stapling is placed on the upper surface 10 of the upper element. Its connection to the pivot pin 4 enables the stapling head 2 to move towards and away from the bottom part 3 in the direction indicated by the double arrow P. Their being connected by the pivot pin 4 likewise enables the upper element 8 and lower element 9 to move towards and away from one another in the direction P.

FIGS. 1 and 4-6 show the upper element 8 connected by second and third pivot pins 12 and 13 respectively to forming means 14 and 15 respectively in such a way that these latter can pivot in the directions V1 and V2.

Figure 2:
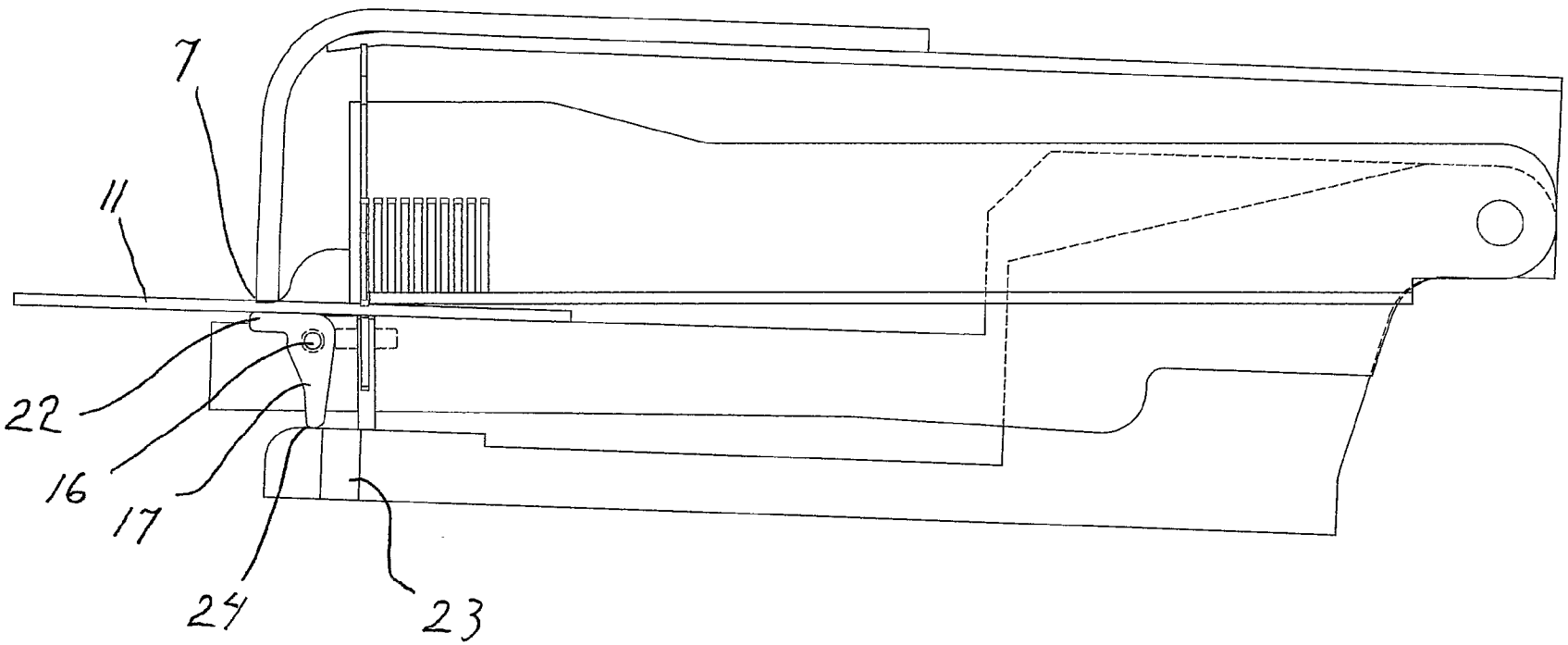
FIG. 2 is a view corresponding to FIG. 1 in which the stapler is in an intermediate state.
Figure 3:
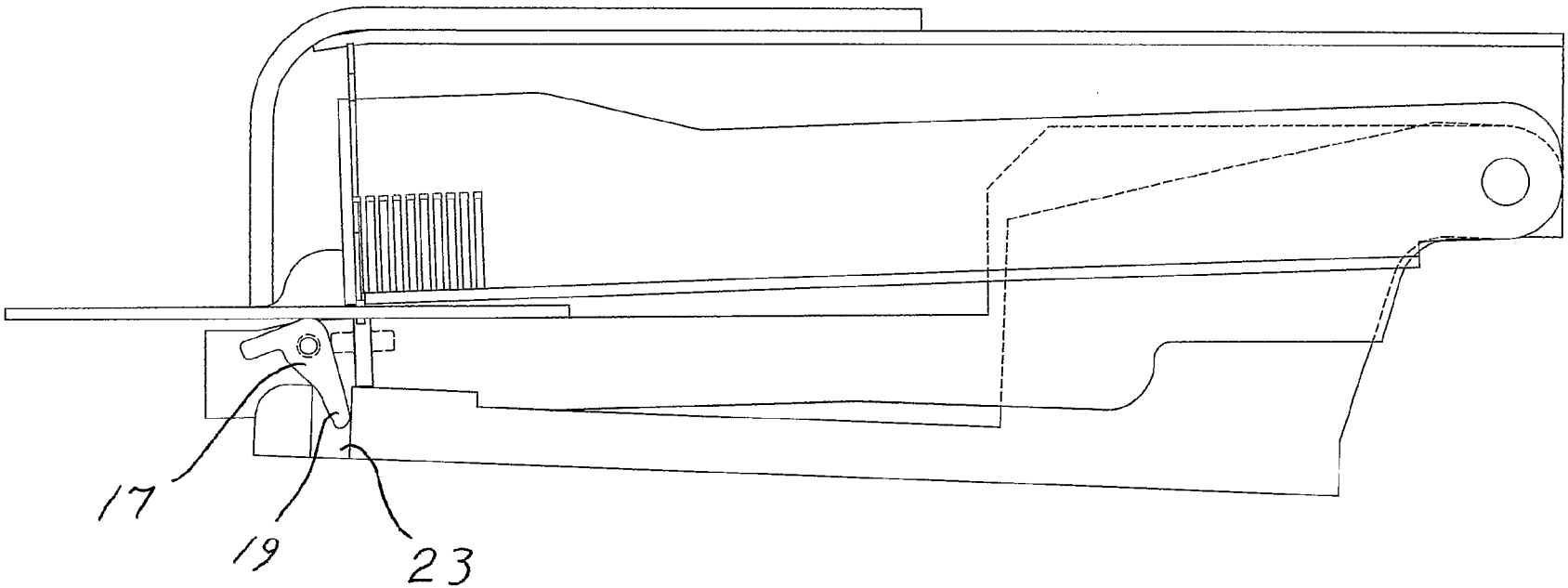
FIG. 3 is a view corresponding to FIGS. 1 and 2 in which the stapler is in a final state.
Figure 4:
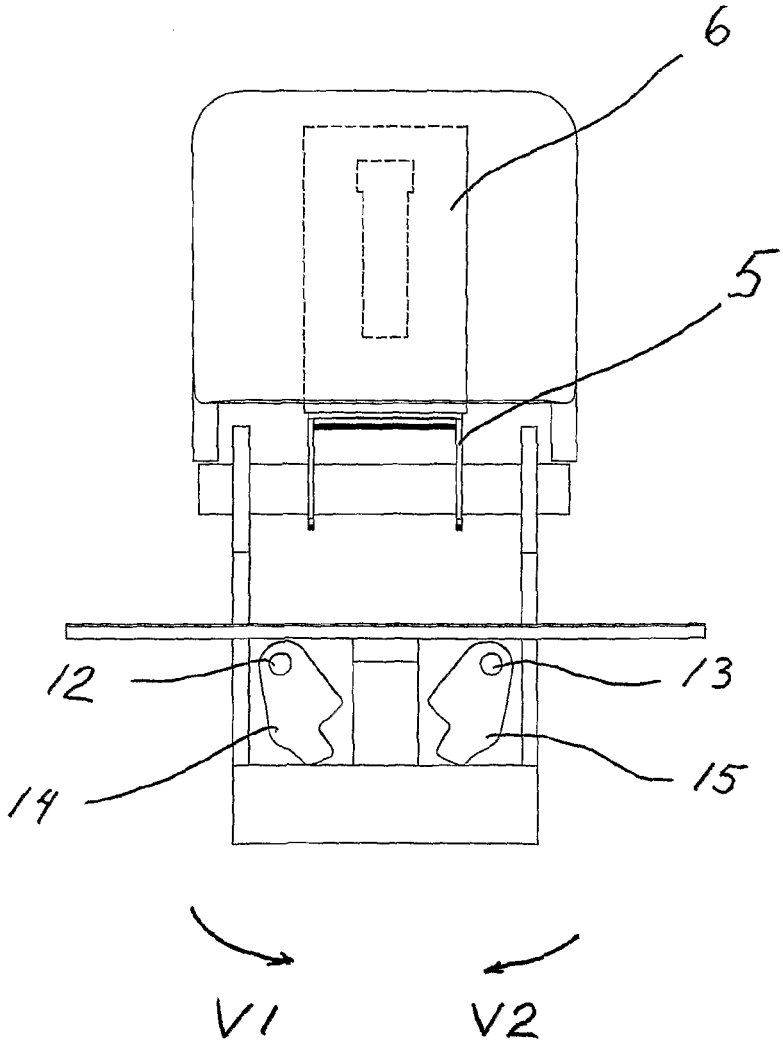
FIGS. 4-6 are schematic views of the stapler corresponding to FIGS. 1-3 as seen from in front.
Figure 5:
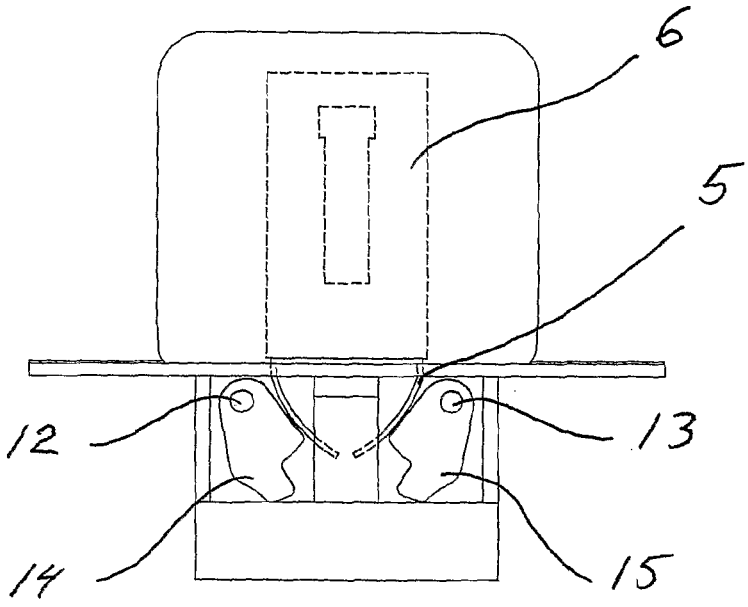
Figure 6:
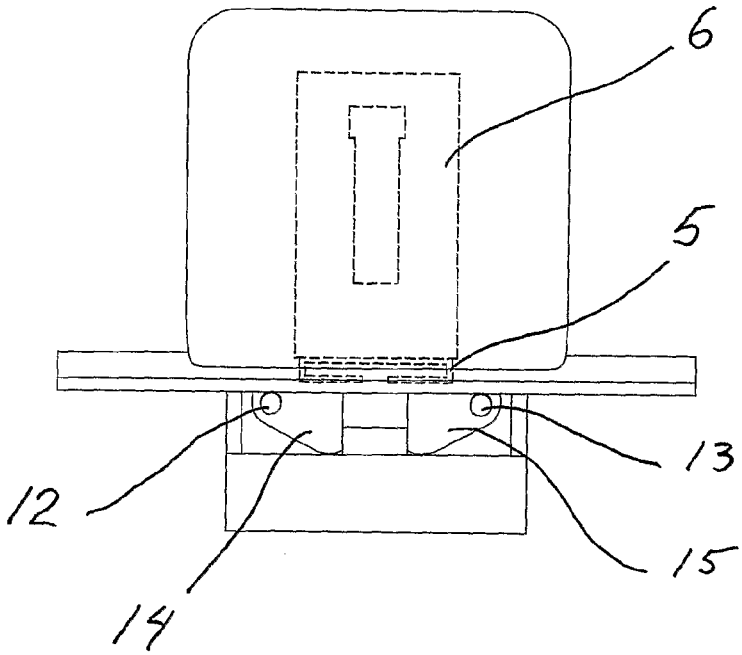
Figure 7:
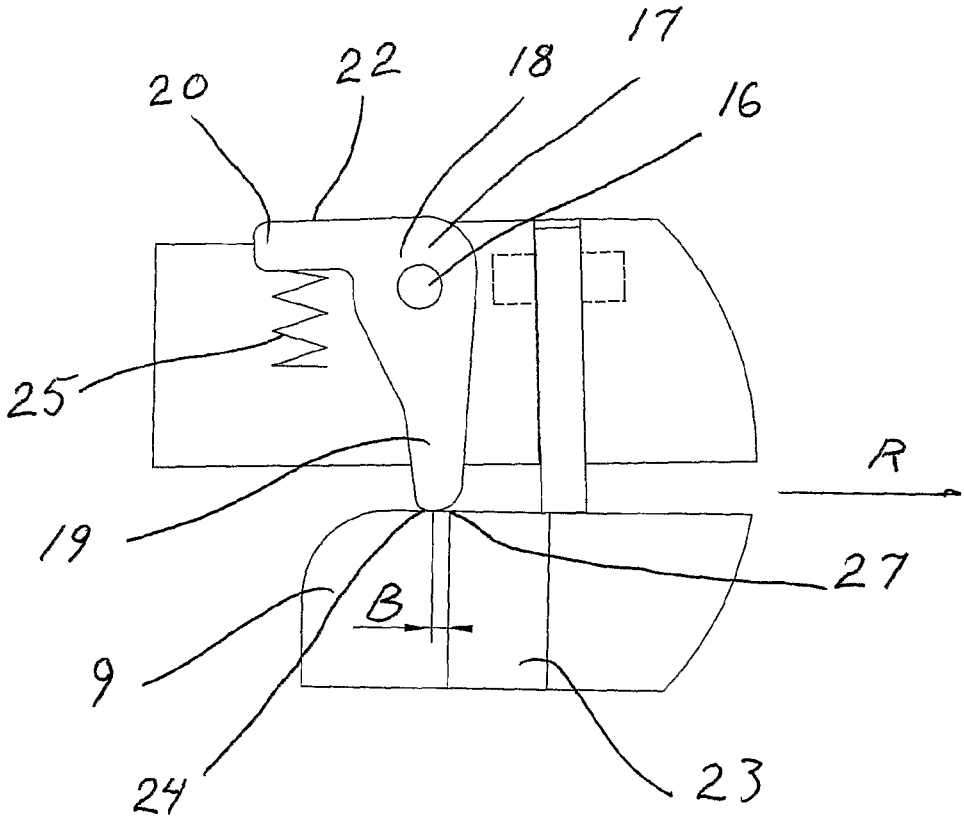
FIG. 7 is a detail view showing in a locking position the locking device which forms part of the invention.
Figure 8:
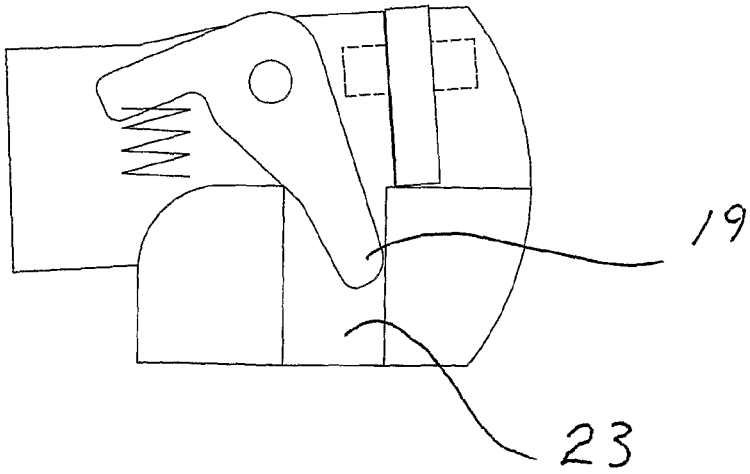
FIG. 8 is a view corresponding to FIG. 7 in which the locking device is in an unlocked state.

FIG. 1 and FIG. 7, the latter being a detailed view of parts essential to the invention, show a locking device 17 disposed pivotably relative to the upper element 8 by a fourth pivot pin 16 and comprising an L-shaped body 18 with a first limb 19 and a second limb 20. The first limb 19 is in locking contact with the lower element 9, and the second limb 20 extends upwards through an aperture 21 in the upper surface 10 of the upper element (see FIG. 9) and constitutes an activating means 22 whose function will be described below. A hollow space 23 whose function will also be described below is provided in the lower element. In the situation depicted in FIGS. 1 and 7, the stapler is in an initial state and the upper element is locked against being able to move towards the bottom part by the fact that the first limb 19 abuts against the lower element via a contact region 24. The locking device is held in an initial state (FIGS. 1 and 7) by an elastic means 25 which in the embodiment example depicted takes the form of a coil spring and which for the sake of clarity is only depicted in FIGS. 7 and 8. A workpiece which is to be stapled is placed on the upper surface 10 of the upper element and a staple is driven by the driver 6 at a driving point 26 (depicted in FIG. 9) in the workpiece until the crown of the staple abuts against the workpiece, which is not illustrated in the drawings but will be obvious to one skilled in the art. In this situation, which corresponds to FIG. 2, the unlocking means 7 disposed on the stapling head acts, via the workpiece, upon the activating means 22 of the locking device, with the result that the first limb 19 moves in the direction indicated by the arrow R and proceeds to enter the hollow space 23 (see FIGS. 7-8), with the result that the limb 19 moves down in the hollow space 23 and the upper element 8 and the lower element 9 move towards one another, resulting in the staple legs being bent by the forming means so that they abut against the underside of the workpiece, as schematically illustrated in FIGS. 4-6.

Figure 9:
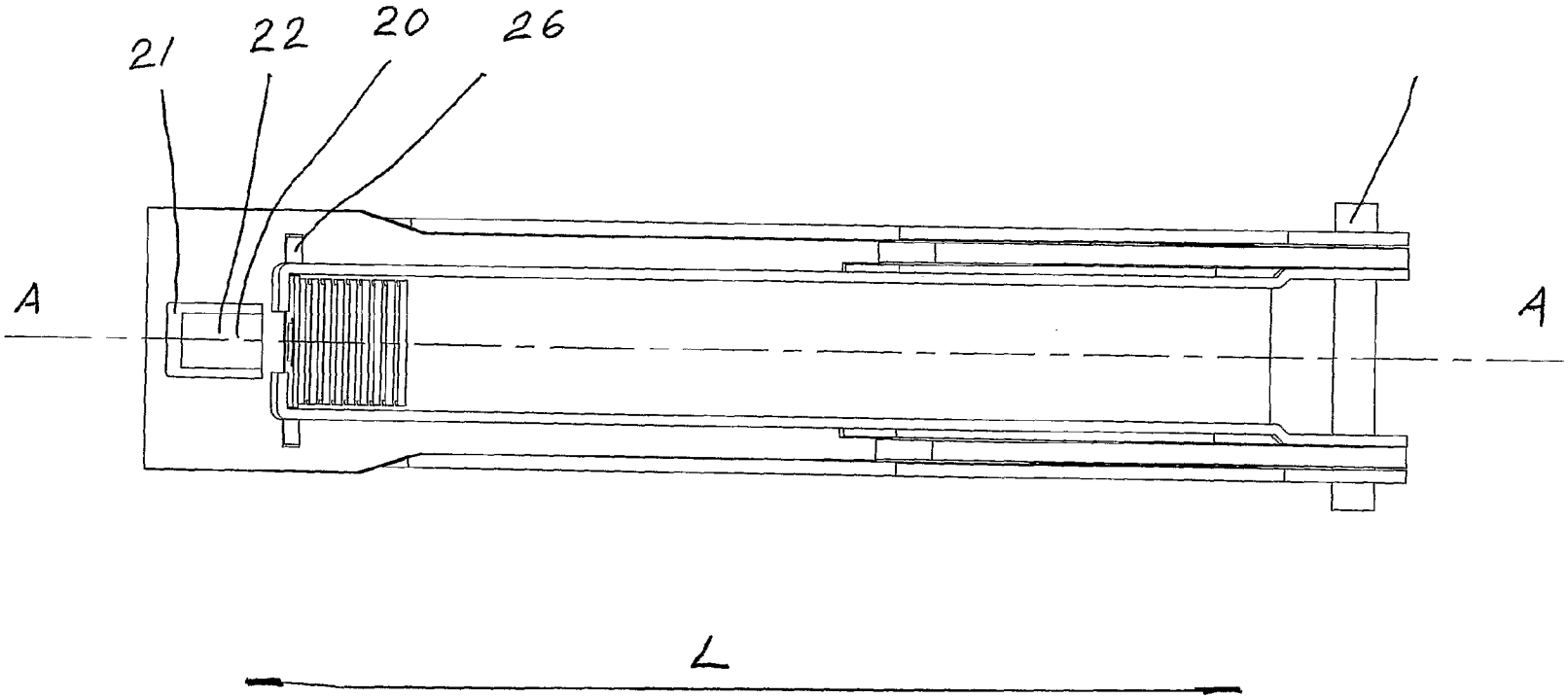
FIG. 9 is a schematic view of a stapler according to the present invention as seen from above.

FIG. 9 shows the activating means 22 of the locking device situated substantially along the longitudinal centreline of the stapler, represented by the chain-dotted line A-A, and at a greater distance in the longitudinal direction of the stapler, denoted by the double arrow L, from the pivot pin 4 than the driving point 26, with the result that the unlocking means 7 situated on the stapling head and in the same position relative to the pivot pin and the centreline of the stapler is subjected, during stapling, to as long a movement as possible in the direction P, thereby ensuring that the locking device is acted upon to such an extent that it is reliably unlocked when the staple has been fully driven into the workpiece. These positionings also mean that the risk of the workpiece 11 being so positioned that it is not between the unlocking means 7 and the activating means 22, which would result in the locking device not being activated during a stapling operation, is largely excluded, with consequently no risk of the locking device failing to unlock.

FIG. 7 depicts the contact area 24 in the initial state situated immediately adjacent to the edge 27 of the hollow space 23 and shows that for reliable unlocking of the locking device the distance B between the edge 27 and the contact region 24 should be within the range 0.3-1 mm and that the device works particularly well if the distance is 0.3-0.5 mm.

The invention claimed is:

1. A stapler (1) by which a workpiece (11) is stapled together with a staple (5), which stapler comprises a stapling head (2) accommodating staples and a driver (6) and connected pivotably by a pivot pin (4) to a bottom part (3) which comprises a lower element (9) and an upper element (8) which are connected to one another in such a way that they can be moved towards and away from one another (P) and which in an initial state, the lower element and the upper element are held fixed in a locking position at a distance from one another by a locking device (17) that prevents the lower element and the upper element from moving towards one another, with forming means (14, 15) arranged between the upper and lower elements, which forming means, when the staple has been fully driven into the workpiece at an insertion area (26) by the driver, bend the staple legs towards the workpiece as a result of the upper and lower elements moving towards one another when the locking device is released by an activating means (22), which is part of the locking device (17), being acted upon by an unlocking means (7) disposed on the stapling head, CHARACTERISED in that in a longitudinal direction (L) of the stapler the activating means (22) of the locking device (17) is situated at a greater distance from the pivot pin (4) than the insertion area (26) of the staple.

2. A stapler (1) according to claim 1, CHARACTERISED in that the activating means (22) is situated substantially along longitudinal centreline (A-A) of the stapler.

3. A stapler (1) according to claim 2, CHARACTERISED in that the locking device (17) is connected pivotably to the upper element (8) and is disposed to be in locking contact, via an edge region (24), with the lower element (9), and wherein, when the activating means releases the locking device, the edge region moves into a hollow space (23) provided in the lower element (9), thereby enabling the upper element (8) to move towards the lower element (9).

4. A stapler (1) according to claim 3, CHARACTERISED in that the edge region (24) in a locking state is situated at a distance (B) of 0.3-1 mm from the edge (27) of the hollow space (23).

5. A stapler (1) according to claim 4, CHARACTERISED in that the distance (B) is 0.3-0.5 mm.

* * * * *